United States Patent [19]

Mizuguchi et al.

[11] Patent Number: 4,801,771

[45] Date of Patent: Jan. 31, 1989

[54] FORCE SENSITIVE DEVICE

[75] Inventors: Masaaki Mizuguchi; Hirohisa Kuroyanagi, both of Shizuoka, Japan

[73] Assignee: Yamaha Corporation, Hamamatsu, Japan

[21] Appl. No.: 107,583

[22] Filed: Oct. 13, 1987

[30] Foreign Application Priority Data

Oct. 13, 1986 [JP] Japan ..... 61-243538
Oct. 13, 1986 [JP] Japan ..... 61-243537

[51] Int. Cl.[4] ..... H01H 3/02; H01H 13/00; G10H 1/34

[52] U.S. Cl. ..... 200/86 R; 178/18; 200/5 A; 200/512

[58] Field of Search ..... 200/5 A, 86 R, 159 B; 178/18

[56] References Cited

U.S. PATENT DOCUMENTS

| | | | |
|---|---|---|---|
| 2,790,873 | 4/1957 | Fleming | 200/86 R |
| 2,843,695 | 7/1958 | Osuch et al. | 200/86 R |
| 3,323,197 | 6/1967 | Millard | 200/86 R |
| 3,668,337 | 6/1972 | Sinclair | 200/86 R X |
| 3,699,294 | 10/1972 | Sudduth | 200/5 A X |
| 3,722,086 | 3/1973 | Wikkerink et al. | 200/86 R |
| 3,793,469 | 2/1974 | Tarnopolsky et al. | 200/5 A X |
| 3,821,500 | 6/1974 | Newman | 200/86 R |
| 3,911,215 | 10/1975 | Hurst et al. | 200/86 R X |
| 4,220,815 | 9/1980 | Gibson et al. | 200/86 R X |
| 4,317,013 | 2/1982 | Larson | 200/5 A |
| 4,324,962 | 4/1982 | Dulen | 200/5 A X |
| 4,360,716 | 11/1982 | Fiorella | 200/5 A |
| 4,382,165 | 5/1983 | Balash et al. | 200/5 A |
| 4,525,606 | 6/1985 | Sado et al. | 200/86 R X |
| 4,602,135 | 7/1986 | Phalen | 200/86 R X |
| 4,677,417 | 6/1987 | Amagishi | 200/86 R X |
| 4,694,126 | 9/1987 | Aiken, Jr. et al. | 200/86 R X |

*Primary Examiner*—J. R. Scott
*Attorney, Agent, or Firm*—Burns, Doane, Swecker & Mathis

[57] ABSTRACT

There is provided a force sensitive device comprising a first conductive layer, a second conductive layer resiliently deformable to come into contact with the first conductive layer, a certain level of voltage being applied across the first and second conductive layers, a plurality of spacing members intervening between the first conductive layer and the second conductive layer and formed of an insulating material, and a resilient top layer of an insulating material overlaid on the second conductive layer and operative to cause the second conductive layer to come into contact with the first conductive layer under a force acting on a surface portion thereof, wherein the contact portion varies in area depending upon a position of the surface portion where the force acts so that the force sensitive device produces the signal having a voltage level which varies depending upon the position where the force acts.

25 Claims, 8 Drawing Sheets

PRIOR-ART

PRIOR-ART

FORCE SENSITIVE DEVICE

FIELD OF THE INVENTION

This invention relates to a force sensitive device and, more particularly, to a force sensitive device serving as a bar incorporated in an electronic percussion system.

BACKGROUND OF THE INVENTION

A typical musical instrument of the acoustic percussion family such as, for example, a xylophone or a marimba is provided with tuned bars in keyboard arrangement and graded in length to provided a chromatic scale of three or four octaves. When a performer strikes the tuned bars with rubber-tipped mallets, the bars vibrate at the respective natural frequencies which cause the bars to produce respective tones so as to make a fine melody.

However, in an electronic percussion system corresponding to the xylophone or the marimba, tones are produced by a tone generation unit incorporated in the system so that bars are only expected to detect forces exerted thereon upon performance. Then, a bar incorporated in the electronic percussion system serves as a force sensitive device and the structure thereof is illustrated in FIGS. 1 and 2.

Referring to FIGS. 1 and 2 of the drawings, there is shown the structure of the typical prior-art force sensitive device serving as a bar incorporated in an electronic percussion system. The prior-art force sensitive device comprises a lower conductive sheet 1, an upper conductive sheet 2 of a resilient material, a plurality of spacing members 3 attached to the lower surface of the upper conductive sheet 2 and formed of an insulating material, and a top layer 4 of an insulating material. The top layer 4 is overlaid on the upper conductive sheet 2 and is resiliently deformed together with the upper conductive sheet 2 upon striking.

Each of the spacing members 3 attached to the lower surface of the upper conductive sheet 2 has a semispherical configuration and a predetermined diameter. As will be seen from FIG. 2, the spacing members 3 are arranged in rows and columns and each spacing member 3 in any one of the rows is spaced from the adjacent spacing member or members in the same row by a preselected distance. Each of the spacing members 3 in any one of the columns is also spaced from the adjacent spacing member or members in the same column by the preselected distance so that every two adjacent spacing members 3 in each row and two adjacent spacing members confronted therewith and belonging to the next row define a rectangular space having a constant area. A certain difference voltage is applied between the lower conductive sheet 1 and the upper conductive sheet 2, and the upper conductive sheet 2 is subjected to deformation and brought into contact with the lower conductive sheet 1 to produce a electrical signal when a performer strikes the top layer 4 with a mallet. The electric signal has a voltage level proportional to a force acting on the top layer 4 upon striking because the larger force a performer applies, the larger contact area the upper and lower conductive sheets 1 and 2 have. This proportional voltage level is preferable to a skilled performer, however beginners can not precisely control the mallets. This means that the beginners need hard trainings so as to perform the electronic percussion system.

SUMMARY OF THE INVENTION

It is therefore an important object of the present invention to provide a force sensitive device preferable to a beginner who cannot precisely control the mallet.

It is another important object of the present invention to provide a force sensitive device operative to produce an electric signal which varies in voltage level depending upon a position on the top layer where a performer strikes.

To accomplish these objects, the present invention proposes to vary the contact area between two conductive layers of a force sensitive device depending upon a position on which a performer strikes.

In accordance with the present invention, there is provided a force sensitive device comprising (a) a first conductive layer, (b) a second conductive layer resiliently deformable to come into contact with a contact portion of the first conductive layer, the second conductive layer coming into contact with the contact portion of the first conductive layer upon application of a force, and (c) a plurality of spacing members intervening between the first conductive layer and the second conductive layer and formed of an insulating material, wherein the contact portion varies in areas depending upon a position where the force acts. In order that the contact portion varies in area depending upon a position where a force acts, the spacing members may be arranged at irregularly intervals. Alternatively, either first or second conductive layer may have a plurality of portions different in area from one another so that the contact portion varies in area depending upon a position where a force acts.

BRIEF DESCRIPTION OF THE DRAWINGS

The features and advantages of a force sensitive device according to the present invention will be more clearly understood from the following description taken in conjunction with the accompanying drawings in which.

DESCRIPTION OF THE PREFERRED EMBODIMENTS

Figure 1:
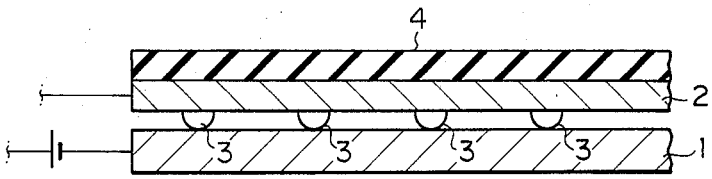
FIG. 1 is a cross sectional view showing the structure of a prior-art force sensitive device.
Figure 2:
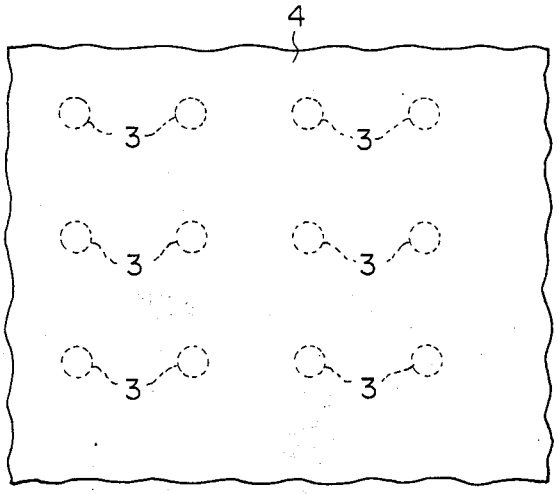
FIG. 2 is a plan view showing the prior-art force sensitive device illustrated in FIG. 1.
Figure 3:
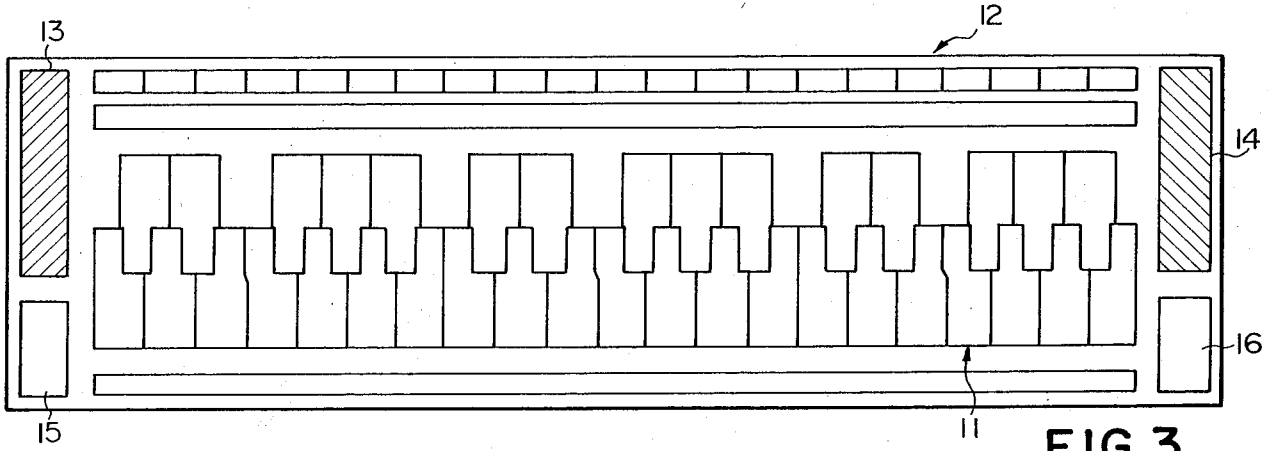
FIG. 3 is a plan view showing a typical example of an electronic percussion system to which the present invention appertains.

Referring to FIG. 3 of the drawings, there is shown a typical example of an electronic percussion system to which the present invention appertains. The electronic percussion system illustrated in FIG. 3 comprises a plurality of force sensitive devices 11 in keyboard arrangement, a set of switches 12 for tone selection, and two loudspeakers 13 and 14. Though not shown in the drawings, control keys such as, for example, a volume key are provided in key ares 15 and 16. Each of the force sensitive devices 11 has two conductive layers isolated from each other in so far as no substantial force acts thereon, however one of the conductive layers is subjected to deformation upon striking and brought into contact with a contact portion of the other conductive layer. The contact portion of the other conductive layer varies in area depending upon a portion where a substantial force acts. The other conductive layer is coupled to a source of voltage such as, for example, a battery V, then a current flows between the two conductive layers to produce a signal having a voltage level reflecting the amount of area or the operated position, namely representing a sound intensity which a performer wants. The signal representing the sound intensity is supplied to an electronic circuit incorporated in the electronic percussion system, and detailed description will be hereinunder made for the electronic circuit with reference to FIG. 4 of the drawings. In FIG. 3, the switches 12 are constructed in similar to the force sensitive devices 11 and may be operated by mallets.

Figure 4:
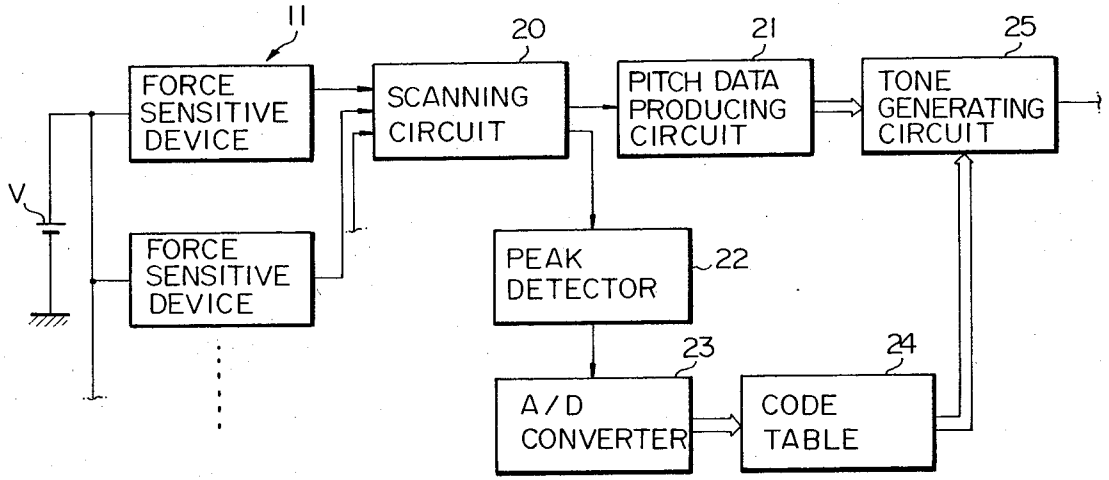
FIG. 4 is a block diagram showing the circuit arrangement of the electronic percussion system illustrated in FIG. 3.

Referring to FIG. 4 of the drawings, the force sensitive devices 11 in the keyboard arrangement are coupled in parallel to a scanning circuit 20 which is operative to identify the force sensitive device supplying the signal thereto. The scanning circuit 20 supplies a signal representing the force sensitive device on which a performer strikes to a pitch data producing circuit 21 and the pitch data producing circuit 21 produces a digital signal representing pitch data based on the signal supplied from the scanning circuit 20. The signal supplied from the force senstive device is passed through the scanning circuit 20 into a peak detector circuit 22 and the peak detector circuit 22 is operative to determine the peak voltage level of the signal supplied from the force sensitive device. The peak detector circuit 22 produces an analog signal representing the peak voltage level and supplies the analog signal to an analog-to-digital converter 23. The analog-to-digital converter 23 is operative to produce a digital signal representing the peak voltage level on the basis of the analog signal supplied from the peak detector circuit 22. The digital signal produced by the analog-to-digital converter 23 implies a sound intensity and a sound lasting condition and is supplied to a code table 24. The code table 24 produces a digital signal representing the sound intensity on the basis of the digital signal supplied from the analog-to-digital converter 23. The digital signal representing the sound intensity is supplied to a tone generating circuit 25 together with the digital signal representing the pitch data from the pitch data producing circuit 21 so that the tone generating circuit 25 produces a tone signal which is supplied to the loudspeakers 13 and 14 through amplifier circuits ( not shown ). The electronic percussion system thus arranged is operative to produce sounds with a tone selected by one of the switches 12 when a performer strikes the force sensitive devices 11 with mallets or sticks. The tone signal produced by the tone generating circuit 25 faithfully reflects the signal representing the sound intensity in accordance with the operated position so that the performer can make a fine melody with changing the striking position but without changing the magnitude of the force applied to the force sensitive device 11.

FIRST EXAMPLE

Figure 5:
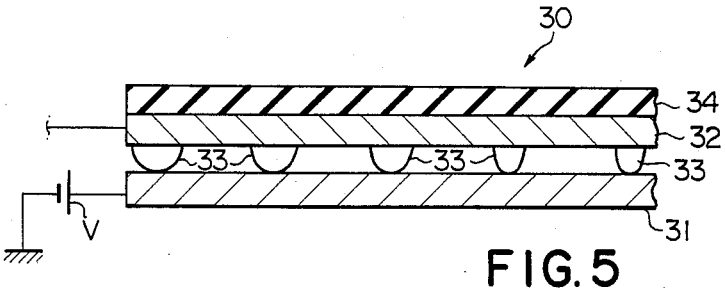
FIG. 5 is a cross sectional view showing the structure of a first example embodying the present invention.
Figure 6:
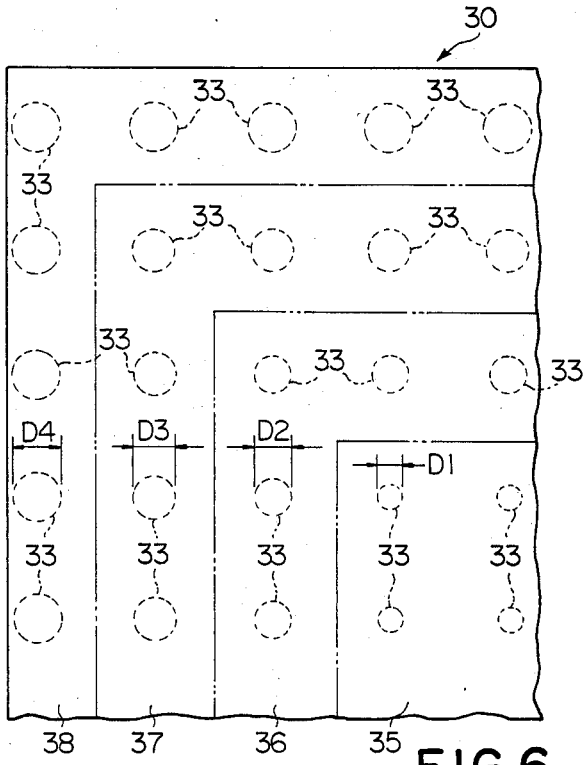
FIG. 6 is a plan view showing the first example of the present invention.

Turning to FIGS. 5 and 6 of the drawings, a fourth of a force sensitive device 30 embodying the present invention is illustrated. The force sensitive device 30 corresponds to one of the force sensitive devices 11 of the electronic percussion system. The force sensitive device 30 comprises a first conductive sheet 31 of a silicon rubber containing carbon particles, a second conductive sheet 32 formed of a silicon rubber containing carbon particles, a plurality of spacing members 33 attached to the lower surface of the second conductive sheet 32 and formed of an insulating material such as raw silicon rubber or silicon rubber without carbon particles, and a top layer 34 overlaid on the second conductive sheet 32 and formed of raw silicon rubber. Each of the spacing members 33 has a substantially semispherical configuration and keep the second conductive sheet 32 in electrical insulation from the first conductive sheet 31 in so far as no substantial force acts on the top layer 34. The silicon rubbers are subjected to deformations under application of a substantial force so that the second conductive sheet 32 is brought into contact with the upper surface of the first conductive sheet 31. Then, the upper surface serves as a contact portion of the first conductive sheet 31. A source of voltage V such as, for example, a battery is connected to the first conductive sheet 31 to produce a signal representing a sound intensity which a performer wants. As will be best shown in FIG. 6, the spacing members 33 are arranged in rows and columns and classified into some groups. Namely, FIG. 6 shows a fourth of the force sensitive device 30 as described hereinbefore so that the four spacing members 33 positioned in the lower end portion of the right side portion are attached to a central zone 35 of the second conductive sheet 32 and have a diameter D1. First, second and third outer zones 36, 37 and 38 are located outside of the central zone 35, respectively, and the spacing members 33 attached to the first, second and third outer zones 36, 37 and 38 have respective diameters D2, D3 and D4. Thus, the spacing members 33 are classified into four groups depending upon the diameter thereof. In this instance, the adjacent spacing members 33 in each row are spaced apart from each other by a regular interval measuring between the centers thereof, and the adjacent spacing members 33 in each column are also spaced apart from each other by the regular interval measuring between the centers thereof. However, the spacing members 33 in each row ( except for the uppermost row ) are positioned at irregular intervals each measuring between the outer peripheral lines thereof, and the spacing members 33 in each column ( except for the leftmost column ) are also located at irregular intervals each measuring between the outer peripheral lines thereof. This means that a rectangular space defined by four spacing members 33 adjacent to one another is different in area from a rectangular spaced defined by other four spacing members 33 adjacent to one another. For example, the rectangular space defined by the four spacing members 33 in the central zone 35 is different in area from the rectangular space defined by the four spacing members 33 positioned in the upper end portions of the left side portion. Assuming now that forces with a certain value act at the respective crossing points of a plural sets of the diagonal lines drawn between the every four spacing members defining the rectangular spaces, respectively, deflections produced in the respective rectangular spaces are different from one another. The larger deflection the rectangular space gets, the larger contact area the first and second conductive sheets 31 and 32 have, then a current flowing between the first conductive sheet 31 and the second conductive sheet 32 is subjected to a resistance which varies in value depending upon a position or a crossing point where the force acts. This results in that the signal supplied from the force sensitive device 30 varies in voltage level depending upon a position where a performer strikes even if the magnitude of the force is constant. Then, if a performer wants to change the sound intensity, the performer need not change the force exerted on the top layer 34, but varies the striking point on the top layer 34. This means that all who want to perform the electronic percussion system can make a fine melody regardless of their experiences.

SECOND EXAMPLE

Figure 7:
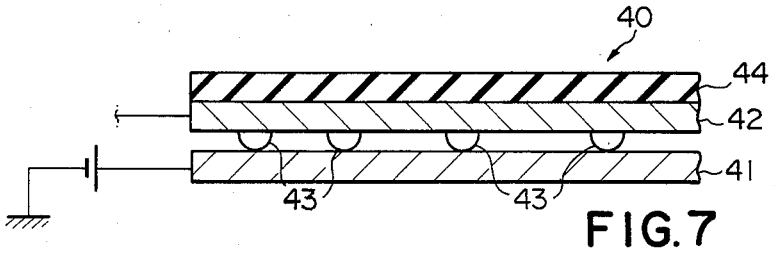
FIG. 7 is a cross sectional view showing a second example embodying the present invention.
Figure 8:
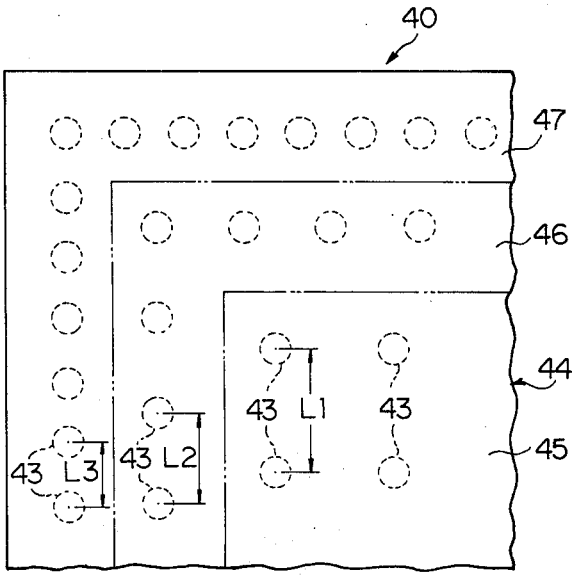
FIG. 8 is a plan view showing the second example of the present invention.

In FIGS. 7 and 8 of the drawings is illustrated a fourth of another force sensitive device 40 which comprises a first conductive sheet 41 of a silicon rubber containing carbon particles, a second conductive sheet 42 formed of a silicon rubber containing carbon particles, a plurality of spacing members 43 attached to the lower surface of the second conductive sheet 42 and formed of raw silicon rubber, and a top layer 44 covering the upper surface of the second conductive sheet 42 and formed of raw silicon rubber. The second conductive sheet 42 is subjected to deformation under application of a substantial force so that the second conductive sheet 42 is brought into contact with the upper surface of the first conductive sheet 41. Then, the upper surface serves as a contact portion of the first conductive sheet 41. FIG. 8 shows a fourth of the force sensitive device 40 similar to FIG. 6, then the lower portion of the right side portion is a part of a central zone 45 of the force sensitive device 40. A first outer zone 46 occupies the outside of the central zone 45 and a second outer zone 47 extends around the first outer zone 46. Each of the spacing members 43 has a semispherical configuration and a preselected diameter, and the two adjacent spacing members 43 in the central zone 45 are spaced apart from each other by a first distance L1 measuring between the centers of the spacing members 43. The two adjacent spacing members 43 in the first outer zone 46 are spaced apart by a second distance L2 which measures between the centers thereof and is shorter than the first distance L1, and the two spacing members 43 in the second outer zone 47 are spaced apart by a third distance L3 which also measures between the centers thereof and is shorter than the second distance L2. The spacing members 43 thus arranged keep the second conductive sheet 42 in electrical isolation from the first conductive sheet 41 in so far as no substantial force acts on the top layer 44 but allow the second conductive sheet 42 to come into contact with a portion of the first conductive sheet 41, the contact area of which varies depending upon an operated portion of the top layer 44 where a substantial force acts. A battery V is connected to the first conductive sheet 41 so that a signal supplied from the force sensitive device 40 also varies a voltage level depending upon a position of the top layer 44 where a performer strikes. With the signal supplied from the force sensitive device 40, an electronic circuit corresponding to the circuit illustrated in FIG. 4 produces a tone signal reflecting intentions of a performer as similar to the first example. In this instance, each of the spacing members 43 has the semispherical configuration identical with those of the other spacing members 43 so that only one type of spacing member 43 is prepared for manufacture and needed for spare parts. This results in reduction of manufacturing and running cost.

THIRD EXAMPLE

Figure 9:
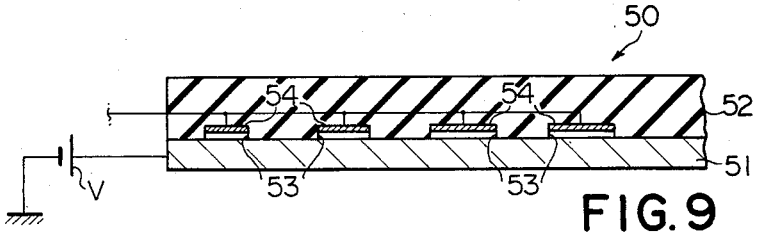
FIG. 9 is a cross sectional view showing a third example embodying the present invention.
Figure 10:
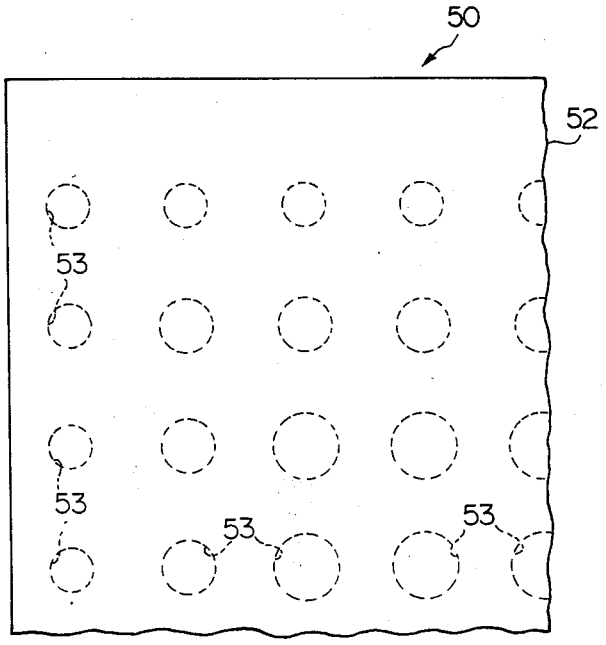
FIG. 10 is a plan view showing the third example of the present invention.

Turning to FIGS. 9 and 10 of the drawings, there is shown the structure of still another force sensitive device 50 embodying the present invention. The force sensitive device 50 illustrated in FIGS. 9 and 10 comprises a first conductive sheet 51 of a silicon rubber containing carbon particles, a relatively thick insulating sheet 52 of raw silicon rubber and formed with a plurality of cylindrical recesses 53, and plurality of conductive circular plates 54 snugly received in the cylindrical recesses 53, respectively. In this instance, the upper surface portion and the lower surface portion of the relatively thick insulating sheet 52 serve as a resilient top layer and spacing members, respectively. In other words, the resilient top layer and the spacing members are merged into the relatively thick insulating sheet 52. Each of the conductive circular plates 54 has a thickness smaller in value than a depth of each cylindrical recess 53 so that each of the conductive circular plates 54 is electrically isolated from the first conductive sheet 51 in so far as no substantial force acts on the upper surface of the relatively thick insulating sheet 50. The conductive circular plates 54 as a whole provide a second conductive sheet and are electrically connected to an electronic circuit corresponding to the circuit illustrated in FIG. 4. On the other hand, the first conductive sheet 51 is coupled to the positive electrode of a battery V. The cylindrical recesses 53 are arranged in rows and columns and the cylindrical recesses 53 in each row ( except for the uppermost row ) are graded in diameter. The cylindrical recesses 53 in each column ( except for the leftmost column ) are also graded in diameter so that the conductive circular plates 54 snugly received therein are brought into contact with a portion of the first conductive sheet 51, the contact area of which varies in area depending upon a position where a substantial force acts or the deformed cylindrical recess 53. When one of the conductive circular plate 54 comes into contact with the first conductive sheet 51, a current flows between the first conductive sheet 51 and the conductive circular plate 54 to produce a signal representing a sound intensity which the performer wants. In this instance, a top layer and spacing members are merged into the relatively thick insulating layer 52. This results in each of fabrication.

FOURTH EXAMPLE

Figure 11:
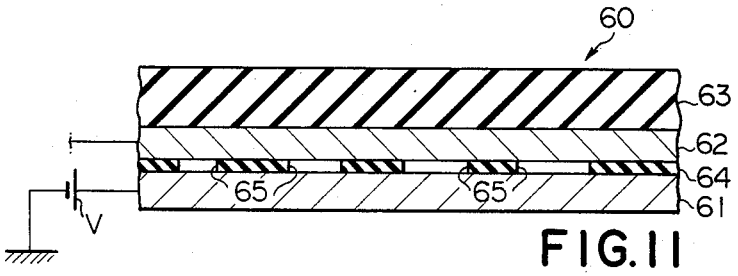
FIG. 11 is a cross sectional view showing a fourth example embodying the present invention.

In FIG. 11 of the drawings is illustrated the structure of still another force sensitive device 60 which comprises a first conductive sheet 61 of a silicon rubber containing carbon particles, a second conductive sheet 62 of a silicon rubber containing carbon particles, a top layer 63 of raw silicon rubber and an intermediate sheet 64 sandwiched between the first and second conductive sheets 61 and 61. The first conductive sheet 61 is coupled to a battery V and the second conductive sheet 62 is electrically connected to an electronic circuit corresponding to the circuit illustrated in FIG. 4. The intermediate sheet 64 is of a polyester resin and formed with a plurality of through holes 65 graded in diameter in a similar manner to the cylindrical recesses 53 of the third example as shown in FIGS. 9 and 10. The second conductive sheet 62 is electrically isolated from the first conductive sheet 61 by the intermediate sheet 64 in so far as no substantial force acts on the top layer 63, however the second conductive sheet 62 is brought into contact with the first conductive sheet 61 when a substantial force acts on the top layer 63. As the through holes are graded in diameter, the contact area varies depending upon a portion where the substantial force acts. Then, the amount of current flowing between the first conductive sheet 61 and the second conductive sheet 62 is varied and, for this reason, a signal supplied from the from the force sensitive device 60 varies in voltage level depending upon a position where the substantial force acts. In this instance, spacing members are provided by a single intermediate sheet 64 and, for this reason, a plenty time and labor for assemblage of the force sensitive device can be reduced.

FIFTH EXAMPLE

Figure 12:
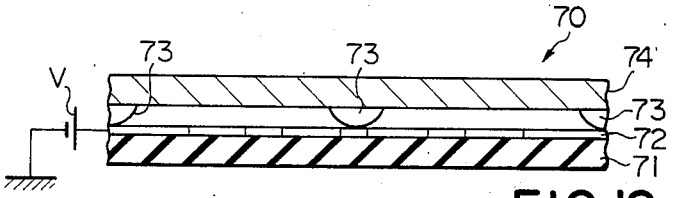
FIG. 12 is a cross sectional view showing a fifth example embodying the present invention.
Figure 13:
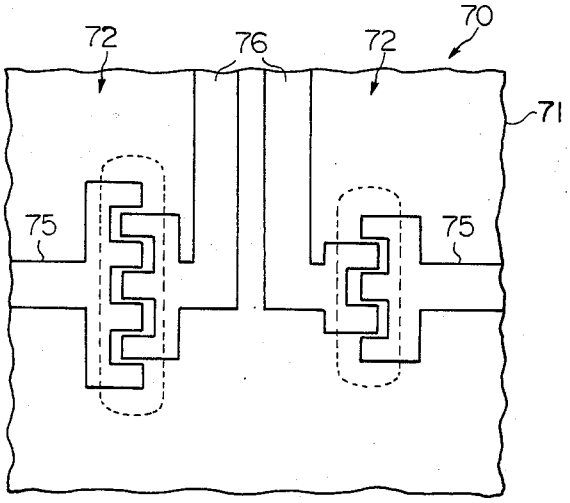
FIG. 13 is a plan view showing a board with conductive patterns forming part of the fifth example of the present invention.

Turning to FIG. 12 of the drawings, the structure of a part of still another force sensitive device 70 is illustrated and comprises a rigid board 71, a plural sets of conductive patterns 72, a plurality of spacing members 73 and a second conductive sheet 74 of a silicon rubber containing carbon particles. As will be best seen from FIG. 13, each set of the conductive patterns consists of two conductive strips 75 and 76 electrically isolated from each other. The conductive strips 75 and 76 have respective leading portions having interdigitated configuration and electrically connected to a battery V and an electronic circuit corresponding to the circuit illustrated in FIG. 4, respectively. The leading portions of the conductive strips 75 are different in area from one another and the leading portions of the conductive strips 76 are also different in area from one another. The spacing members 73 keep the second conductive sheet 74 in electrical isolation from the conductive patterns 72 in so far as no substantial force acts. However, the second conductive sheet 74 is subjected to deformation under application of a substantial force and is brought into contact with one of the conductive patterns 72. The deformed second conductive sheet 74 provides a conduction path from the conductive strip 75 to the conductive strip 76 so that a current flows from the conductive strip 75 to the conductive strip 76 to produce a signal representing a sound intensity which a performer wants. Though not shown in the drawings, the second conductive layer 74 may be covered with an insulating film.

Figure 14:
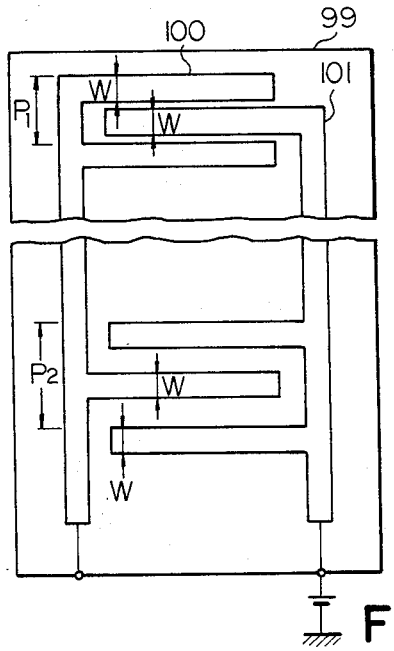
FIG. 14 is a plan view showing a modification of the fifth example of the present invention.

Turning to FIG. 14 of the drawings, there is shown a modification of the fifth example which comprises a rigid board 99, a first conductive layer 100 having a plurality projections with an irregular pitch, and a second conductive layer 101 having a plurality of projections with an irregular pitch. The first and second conductive layers 100 and 101 have interdigitated configuration, and each projection of the first and second conductive layers 100 and 101 has a constant width. Though not shown in the drawings, a conductive sheet overlies the rigid board 99 but is electrically isolated from the first and second conducting layers 100 and 101 by a plurality of insulating materials (not shown) arranged in rows and columns.

Figure 15:
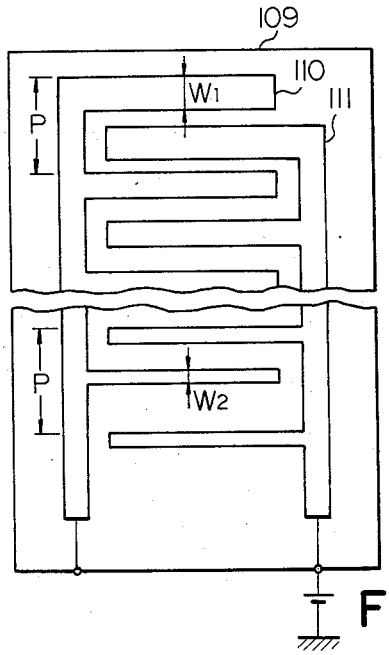
FIG. 15 is a plan view showing another modification of the fifth example of the present invention.

In FIG. 15 is illustrated another modification of the fifth example which comprises a rigid board 109, a first conductive layer 110 having a plurality projections with a regular pitch, and a second conductive layer 111 having a plurality of projections with a regular pitch. The first and second conductive layers 110 and 111 have interdigitated configuration, and the projections of the first conductive layer 110 are different in width from one another. Similarly, the projections of the second conductive layer 111 are different in width from one another. Though not shown in the drawings, a conductive sheet overlies the rigid board 109 but is electrically isolated from the first and second conductive layers 110 and 111 by a plurality of insulating materials (not shown) arranged in rows and columns.

Although particular embodiment of the present invention have been shown and described, it will be obvious to those skilled in the art that various changes and modifications may be made without departing from the spirit and scope of the present invention. For example, the first conductive sheets 31, 41, 51 and 61 of the respective first to fourth examples may be formed with a print circuit board having a conductive pattern of a appropriate configuration thereon in place of the silicon rubber containing carbon particles as mentioned above.

What is claimed is:

1. A force sensitive device comprising:

(a) a first conductive layer;

(b) a second conductive layer with an insulative backing layer resiliently deformable to come into contact with a contact portion of said first conductive layer upon application of a force to said insulative backing layer, the magnitude of said force being approximately equal in every application; and (c) a plurality of spacing members attached to preselected positions of said second conductive layer, respectively, for intervening between said first conductive layer and said second conductive layer and formed of an insulating material, wherein said preselected positions are successively varied in area for variance of the contacting areas of the conductive layers.

2. A force sensitive device as set forth in claim 1, in which said spacing members are arranged in rows and columns and are attached to said preselected positions of said second conductive layer, respectively, said preselected positions in at least one row being varied in area.

3. A force sensitive device as set forth in claim 2, in which said preselected positions in at least one column are varied in area.

4. A force sensitive device as set forth in claim 3, in which each of said spacing members has a substantially semispherical configuration.

5. A force sensitive device as set forth in claim 1, in which said spacing members are integral with said insulative backing layer to form a plurality of depressions open to a surface of said first conductive layer and in which a plurality of strips forming said second conductive layer are respectively received in said depressions.

6. A force sensitive device as set forth in claim 5, in which said depressions are arranged in rows and columns and in which said depressions in at least one row have respective cross-sections classified into a plurality of groups in terms of area.

7. A force sensitive device as set forth in claim 5, in which said depressions in at least one column have respective cross-sections classified into a plurality of groups in terms of area.

8. A force sensitive device as set forth in claim 5, in which said depressions are classified into at least first and second groups, the depressions of said first group being located at a central zone of said insulative backing layer, the depressions of said second group being located on an outer zone of said insulative backing layer, wherein each depression of said first group is different in area from the depressions of said second group.

9. A force sensitive device as set forth in claim 5, in which each of said depressions has a circular cross section.

10. A force sensitive force as set forth in claim 1, in which said second conductive layer is formed of silicon rubber containing carbon particles.

11. A force sensitive device as set forth in claim 1, in which said insulative backing layer is formed of silicon rubber without carbon particles.

12. A force sensitive device comprising:

(a) a first conductive layer;

(b) a second conductive layer with an insulative backing layer resiliently deformable to come into contact with a contact portion of said first conductive layer upon application of a force to said insulative backing layer, the magnitude of said force being approximately equal in every application; and (c) a plurality of insulative spacing members identical in geometry with one another and attached to preselected positions of said second conductive layer, respectively, for intervening between said first conductive layer and said second conductive layer, wherein said spacing members are classified into more than three groups, every adjacent two of said spacing members in one of said groups being spaced by a first distance different in length from a second distance between adjacent two of said spacing members in another group, every adjacent two or said spacing members in still another group being spaced by a third distance different in length from said first and second distances.

13. A force sensitive device as set forth in claim 12, in which said second conductive layer has a surface classified into a central zone and at least two outer zones and in which said one of groups, said another group and said still another group are attached to said central zone and said at least two outer zones, respectively.

14. A force sensitive device comprising:

(a) a first conductive layer;

(b) a second conductive layer with an insulative backing layer resiliently deformable to come into contact with a contact portion of said first conductive layer upon application of a force to said insulative backing layer, the magnitude of said force being approximately equal in every application; and (c) an insulating intermediate sheet intervening between said first conductive layer and said second conductive layer and formed with a plurality of through holes each open at both sides thereof to respective surfaces of said first and second conductive layers, wherein said through holes have respective cross-sections classified into a plurality of groups in terms of area.

15. A force sensitive device as set forth in claim 14, in which said through holes are arranged in rows and columns and in which said through holes in at least one row have respective cross-sections varied in area.

16. A force sensitive device as set forth in claim 14, in which said through holes in at least one column have respective cross-sections varied in area.

17. A force sensitive device as set forth in claim 14, in which said insulating intermediate sheet has a central zone and at least one outer zone and in which each of said through holes in the central zone has a crosssection different in area from that of said through holes in the outer zone.

18. A force sensitive device as set forth in claim 14, in which said insulating intermediate sheet is formed of a polyester resin.

19. A force sensitive device as set forth in claim 14, in which each of said through holes has a circular cross section.

20. A force sensitive device comprising:

(a) a first conductive layer formed on an insulating carrier sheet;

(b) a second conductive layer resiliently deformable to come into contact with one of plural contact portions of said first conductive layer upon application of a force, the magnitude of said force being approximately equal in every application; and (c) a plurality of insulative spacing members attached to preselected positions of said second conductive layer, respectively, for allowing said first conductive layer to be spaced from said second conductive layer, wherein said contact portions of said first conductive layer have respective area classified in terms of area for variance of the contacting areas of the conductive layers with one of said respective areas coming into contact with said second conductive layer.

21. A force sensitive device as set forth in claim 20, in which said contact portions respectively have a plurality of conductive patterns each consisting of first and second strips electrically isolated from each other.

22. A force sensitive device as set forth in claim 21, in which one of said conductive patterns has the first and second strips different in area from the first and second strips of another conductive patterns, respectively.

23. A force sensitive device as set forth in claim 21, in which the first and second strips of each conductive pattern has an interdigitated configuration.

24. A force sensitive device as set forth in claim 23, in which the first and second strips of one of said conductive patterns are different in width from the first and second strips of another conductive pattern.

25. A force sensitive device as set forth in claim 23, in which the first and second strips of one of said conductive patterns are spaced from each other by a first distance and in which the first and second strips of another conductive pattern are spaced from each other by a second distance different from said first distance.

* * * * *